United States Patent [19]

Friedman

[11] Patent Number: 4,703,798

[45] **Date of Patent: * Nov. 3, 1987**

[54] IN SITU METHOD FOR RECOVERING HYDROCARBON FROM SUBTERRANEAN OIL SHALE DEPOSITS

[75] Inventor: Robert H. Friedman, Houston, Tex.

[73] Assignee: Texaco Inc., White Plains, N.Y.

[ * ] Notice: The portion of the term of this patent subsequent to Jan. 28, 2003 has been disclaimed.

[21] Appl. No.: 880,254

[22] Filed: Jun. 30, 1986

[51] Int. Cl.[4] ..... E21C 43/00

[52] U.S. Cl. ..... 166/271; 208/431; 208/435; 166/272; 166/266

[58] Field of Search ..... 208/431, 435, 433, 403; 299/3, 4, 5; 166/271, 272, 259, 266

[56] References Cited

U.S. PATENT DOCUMENTS

| | | | |
|---|---|---|---|
| 3,770,398 | 11/1973 | Abraham et al. | 299/3 X |
| 3,902,422 | 9/1975 | Coursen | 299/5 X |
| 4,220,203 | 9/1980 | Steeman | 299/5 X |
| 4,324,641 | 4/1982 | Durai-Suamy | 208/431 X |
| 4,547,019 | 10/1985 | Warzel | 299/5 X |
| 4,566,964 | 1/1986 | Friedman | 208/435 X |

*Primary Examiner*—Andrew H. Metz
*Assistant Examiner*—Glenn Caldarola
*Attorney, Agent, or Firm*—Jack H. Park; Kenneth R. Priem

[57] ABSTRACT

Hydrocarbons may be recovered from subterranean oil shale deposits by penetrating the deposit with a well, applying hydraulic and/or explosive fracturing to the portion of the formation adjacent the well to form a zone of rubberized and/or fractured oil shale material and then introducing it to the treated portion of the formation a hydrogen doner solvent, preferably tetralin, in a sufficient volume to essentially fill all of the void spaces in the formation within the rubberized and fractured portion of the formation, and then applying hydrogen to the well and maintaining the hydrogen at a pressure range of from 50 to 500 and preferably from 250 to 350 pounds per square inch for a period of time in the range of from 50 to 600 and preferably 250 to 350 days, which causes a disintegration of the oil shale minerals. After this first stage pretreatment, the hydrogen is removed and a free-oxygen containing gas such as air is introduced into the pretreated portion of the oil shale deposit which removes organic fragments from the polymeric kerogen component of the oil shale by oxidative scission. A suitable solvent for the organic fragments is also present with the free oxygen containing gas. Fluids are recovered from the formation, since fluids including solvent and the organic fractions, which are separated by sublimation with the solvent being recycled.

23 Claims, 1 Drawing Figure

IN SITU METHOD FOR RECOVERING HYDROCARBON FROM SUBTERRANEAN OIL SHALE DEPOSITS

CROSS REFERENCE TO RELATED PATENT AND APPLICATION

This Application is closely related to U.S. Pat. No. 4,566,964 which issued Jan. 28, 1986 for Method of Recovering Hydrocarbon from Oil Shale (208/8LE). It is also related to copending application for Method for Recovering Hydrocarbons from Oil Shale, Ser. No. 6/880,362, filed on Jun. 30, 1986.

FIELD OF THE INVENTION

This invention concerns a new and novel method for recovering hydrocarbon materials from oil shale. More specifically, this invention is concerned with an in situ method for recovering hydrocarbons from subterranean oil shale deposits. Still more specifically, this invention is concerned with an in situ method for recovering hydrocarbon from oil shale deposits which have been penetrated by a well and a portion of the deposit around the well has been rubbilized and/or fractured comprising treating that portion of the formation with a hydrogen donor solvent and gaseous hydrogen and subsequently treating by a chemical oxidation to remove at least a portion of the hydrocarbon material from the kerogen component of the oil shale while leaving the mineral portion of the oil shale in the subterranean deposit.

BACKGROUND

Throughout the world there are vast reserves of hydrocarbons in the form of oil shales. Oil shales are sedimentary inorganic materials that contain appreciable organic material in the form of high molecular weight polymers. The inorganic portion of the oil shale is a marlstone-type sedimentary rock. Most of the organic material is present as kerogen, a solid, high molecular weight, three dimensional polymer which is insoluble in conventional organic solvents. Usually the naturally-occurring oil shales contain a small amount of a benzene-soluble organic material which is referred to as bitumen.

The most extensive oil shale deposits in the United States are the Devonian-Mississippian shales. The Green River formation of Colorado, Utah and Wyoming is a particularly rich deposit, and includes an area in excess of 16,000 square miles. The in-place reserves of the Green River formation alone exceed 3 trillion barrels. The Piceance Basin of Colorado represents nearly 85 percent of the Green River reserves.

A typical Green River Oil Shale is comprised of approximately 85 wt. percent mineral (inorganic) components, of which the carbonates are the predominate species, and lesser amounts of feldspars, quartz and clays are also present. The kerogen component represents essentially all of the organic material, and the elemental analysis is approximately 78% carbon, 10% hydrogen, 2% nitrogen, 1% sulfur and 9% oxygen.

Most of the methods for recovering hydrocarbon or organic material from oil shale materials involve mining the oil shale material, crushing it, and subjecting the crushed oil shale materials to thermal decomposition. The thermal decomposition of oil shale, i.e. pyrolysis or retorting, yields liquid, gases and solid (coke) products. The relative amounts of oil, gas and coke produced are controlled primarily by varying the parameters of temperature and time during the course of retorting the oil shale. Modern oil shale retorting processes operate at about 480° C., (896° F.) in order to maximize the yield of liquid hydrocarbon products.

Several major problems remain unsolved in the commercialization of the processes for recovering hydrocarbon from oil shale by retorting. The cost of mining the oil shale rock is excessive even in shallow deposits. One in situ retorting process has been described in the literature, where a rubbilized zone is created and a retorting process is applied in situ. This is applicable only to shallow deposits and yields are even less than surface retort yields because of the difficulty in controlling operating parameters. A substantial amount of the hydrocarbon component of the oil shale is consumed by combustion to generate the high temperatures needed for the pyrolysis reaction. The synthetic crude produced by retorting is very high in olefins and low in saturates and aromatics, and so a substantial amount of hydrogen must be added during refining to produce a good quality crude suitable for conventional refining. The hydrocarbon fraction which is produced in the gaseous state in the retorting process is greatly diluted by carbon dioxide resulting not only from the combustion of hydrocarbon portions of the oil shale, but also from thermal decomposition of the carbonate mineral fraction of the oil shale. Since dolomite and calcite are stable at temperatures far above the normal retorting temperatures, most of this carbon dioxide is derived from decomposition of dawsonite and nahcolite.

The state-of-the-art surface retorting method only recovers about 56% of the kerogen as a useful product. Because of this, as well as the other problems discussed above, there is essentially no commercial production of synthetic crude oil from oil shale in the United States at the present time despite the enormous reserves represented by the oil shale deposits. It can be seen from the foregoing discussion that there is a substantial, unfulfilled need for a new process for recovering useful hydrocarbon products from oil shale by an in situ process which eliminates the need to mine the oil shale rock, or reduces the cost for recovering the oil, or increases the percent of kerogen converted to useful product, or preferably accomplishes many or all of these objectives.

In my U.S. Pat. No. 4,566,964 which issued Jan. 28, 1986 for a Method of Recovery of Hydrocarbon from Oil Shale, there is disclosed a process in which mined oil shale material is crushed and ground to a predetermined fineness and then contacted with a free oxygen-containing gas such as air in a solvent for the organic fragments which are extracted from the polymeric kerogen components. The preferred solvents are naphthalene, tetralin and phenanthracene. The solvent which contains the organic fractions separated from the kerogen polymer is then separated into solvent and the organic fraction by sublimation. The residual solids comprising mineral and unoxidized kerogen is then subjected to a bake-off to recover additional organic materials from kerogen. This process permits recovery of hydrocarbon from oil shale materials using much lower temperatures than conventional retorting techniques, and accomplishes an increased recovery efficiency. The method does require that the oil shale material first be removed from the subterranean formation, and that it be crushed and ground to a relatively fine consistency. The cost of this mining, crushing and grinding operation is substantial and it is an object of the present invention to eliminate the need to mine the oil shale in order to reduce the overall cost of extracting hydrocarbon from the oil shale deposits.

SUMMARY OF INVENTION

Briefly the process of my invention involves penetrating a subterranean oil shale deposit with one or more wells and applying either explosive fracturing, hydraulic fracturing, or a combination of the processes to the oil shale formation adjacent the well in order to create a zone of rubbilized oil shale material and/or fractured formation. This first step utilizes techniques which are well known in the oil well drilling and completion art and commercially available from oil service companies. A well is completed in the treated zone in the oil field formation, paying special care to obtain a pressure resistant seal between the well and the overburden formation, since the rubbilized and/or fractured zone will be pressurized. A hydrogen doner solvent, preferably tetralin is then introduced into the zone, essentially filling the void space created within the rubbilized and/or fractured formation area with tetralin. Hydrogen gas is then utilized to pressurize the fluid in the zone from which recovery is to be achieved, and the tetralin and hydrogen are left in the zone for a period of from 50 to 600 and preferably from 250 to 350 days. I have discovered that tetralin causes a disintegration of hard oil shale rock which I have not observed when oil shale rock is contacted with any other solvent. The pressure is maintained by adding hydrogen as necessary for the period of time that the tetralin is left in the formation, preferably maintaining the maximum pressure which can be maintained on the particular formation without causing a fracture of the overburden formation. The pressure is then carefully reduced and hydrogen is removed. In the next step, a mixture of a free oxygen-containing gas, preferably air and a solvent for the organic fragments which will be removed from the kerogen molecules by oxidative scission is introduced into the formation. The solvent may be tetralin, as well as naphthalene and phenanthracene. In a preferred embodiment, additional wells are completed in the zone of the formation being treated, so solvent and air can be introduced separately. Optimum results are obtained if in excess of the amount of air which can be dissolved in the solvent is utilized, and forced to flow through the solvent rock mixture. Fluids are recovered from the treated zone, which comprises solvent having dissolved therein the organic material separated from the kerogen polymer by oxidative scissions, which are transported to the surface of the earth. Solvent and the organic material separated from kerogen are then separated by sublimation, with the solvent being recycled into the formation. The step of injecting air and solvent is continued until the amount of organic material separated from the kerogen decreases to a level of making further continuation of the process uneconomic. Additional kerogen recovery may be achieved by injecting a high temperature fluid such as steam into the formation.

BRIEF DESCRIPTION OF THE DRAWING

The attached drawing illustrates a preferred embodiment of the process of my invention whereby a subterranean oil shale deposit is penetrated by a well and fractured and/or rubbilized, and then chemically treated with tetralin and hydrogen to chemically shatter or disintegrate the oil shale material, after which the formation is subjected to oxidative scission using air and solvent which recover hydrocarbon from kerogen, with the solvent and hydrocarbon kerogen-derived materials are produced to the surface, and the solvent and hydrocarbon are separated.

DETAILED DESCRIPTION OF THE PREFERRED EMBODIMENTS

Figure 1:
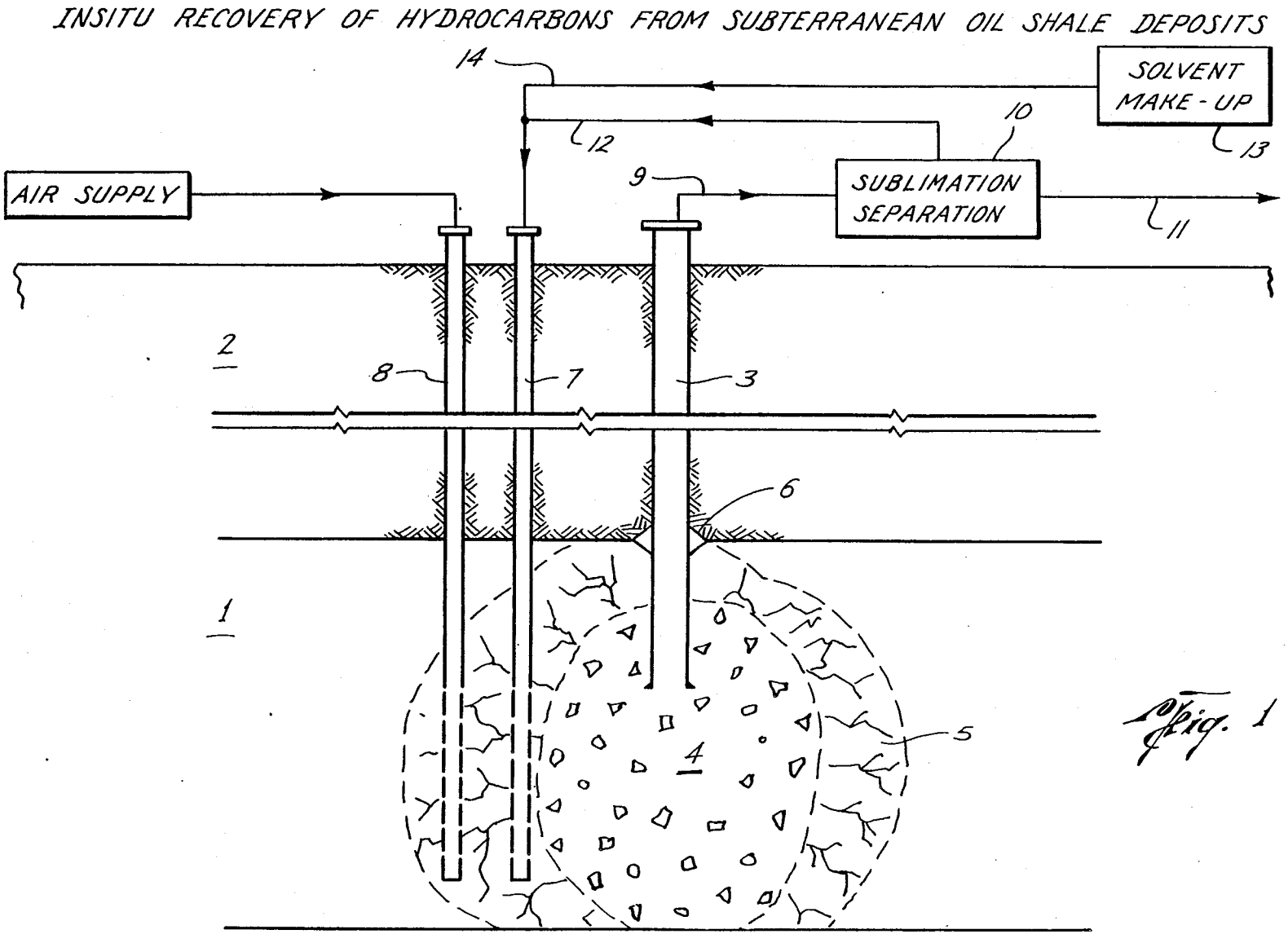

The objective of the research which lead to the discovery of the method that constitutes my invention was the development of a process for recovering usable products from oil shale, which utilized a minimum amount of both energy and water. The reduction in energy was desirable in order to improve the economics of the process as compared to state-of-the-art surface retorting techniques, and the reason for developing a system which requires a minimum amount of water was the fact that water is in very short supply in the areas where the largest and richest oil shale deposits are located. Since mining is expensive, in situ separation of hydrocarbons from subterranean oil shale deposits was a high priority objective.

In applying the process described in my U.S. Pat. No. 4,566,964, it is necessary to mine the oil shale and then crush and grind the rock to a fairly fine texture for the purpose of achieving contact between the oxidative environment and the kerogen fraction of the oil shale mineral. I have now discovered that fairly large pieces of oil shale material can be treated chemically in order to cause disintegration of the mineral material to a degree sufficient to provide the desired access between the oxidative environment described in U.S. Pat. No. 4,566,964 and the kerogen present in the oil shale. The present invention, therefore, comprises an in situ treatment to be applied to oil shale material in subterranean deposits which have been penetrated by a well and the rock formation treated by explosive and/or hydraulic fracturing to increase the contact and access of fluids injected into the treated zone in the formation. I have discovered that tetralin as well as other hydrogen doner solvents, if allowed to contact fairly large pieces of oil shale rock, cause a disintegration of the rock matrix after a period of time which is equivalent to crushing and grinding, and greatly increases the access of subsequently injected fluids which must contact the kerogen polymer to cause oxidative scission of hydrocarbon fragments from the kerogen molecule. It is theorized that atomic hydrogen from the tetralin or other hydrogen solvent doner diffuses into the rock and is responsible for the disintegration of the rock matrix. It is further theorized that hydrogen contacts oxygen naturally occurring in the oil shale mineral, which produces a reaction which increases pressure within the mineral, causing rupture of the mineral matrix. Although tetralin is one of the effective solvents to be used in the oxidative treatment process described in my U.S. Pat. No. 4,566,964, along with naphthalene and phenanthracene, only tetralin will cause the disintegration of rock necessary for this first step which causes sufficient disintegration of the rock for the oxidative scission treatment described in U.S. Pat. No. 4,566,964 to proceed with any reasonable efficiency in a subterranean formation.

After the formation has been penetrated by the well and the fracturing and/or explosive treatment process has been applied, a well must be completed into the center of the rubbilized zone with particular care being paid to the cement job or other means of establishing a pressure tight seal between the well casing and the overburden formation, since the portion of the formation being treated will be maintained under fairly high pressure for a substantial period of time. Such well completions are well within the scope of available state-of-the-art completion techniques.

Only one well is necessary in the first stage process, although, of course, a large zone may be treated with a plurality of wells each independently serving essentially the same function. Tetralin is introduced into the formation via the well in order to fill as nearly as possible all of the void spaces created by the explosion and the fracturing treatment applied to the formation. Hydrogen is then applied to the well to raise the pressure in the zone occupied by the tetralin to a value in the range of from 50 to 500 and preferably 250 to 350 pounds per square inch. Since oil shale formations are very impermeable to fluids, the well may be closed in and allowed to remain without further treatment during the soak period, although some gas migration will occur and optimum results are achieved if sufficient hydrogen is added to the zone of the formation being treated on a regular basis in order to maintain pressure in the formation within the limits defined above. Although disintegration of coarsely crushed oil shale material will occur in a matter of a few days, in order to accomplish the deep penetration necessary to achieve disintegration of the mineral matrix in the process described herein, much longer periods of time will be necessary since atomic hydrogen must diffuse greater distances from the access surfaces into the undisturbed oil shale formation rock. For this reason, it is desirable that the tetralin be allowed to remain under the pressure defined above for a period of from 50 to 600 and preferably 250 to 350 days. This ensures maximum penetration of atomic hydrogen from the hydrogen doner solvent into the oil shale material and maximum disintegration of the hard mineral matrix of the oil shale material.

After the above prescribed period has been completed, hydrogen is removed from the formation and the next step involves applying the oxidative scission treatment described in U.S. Pat. No. 4,566,964. The treatment involves contacting the pretreated oil shale material with a mixture of a free-oxygen containing gas, usually air, and an effective solvent for the organic fragments which are separated from the kerogen polymer by the oxidative scission process. The three solvents described in U.S. Pat. No. 4,566,964 are effective in the present in situ recovery technique, those solvents being tetralin, phenanthracene and naphthalene. Since tetralin is already present in the formation, one embodiment involves leaving tetralin in the formation and utilizing it in the second step of the process of my invention. If desired, the tetralin may be pumped from the formation and utilized at another stage in a remotely located zone of the oil shale formation, and either naphthalene or phenanthracene used in the oxidative treatment stage of my process. It may be necessary to heat the solvent sufficiently to ensure that it is in the liquid state when it is pumped into the formation, and the natural formation temperature may influence the choice of an optimum solvent for use in the process of my invention.

Optimum results are obtained in the oxidative scission step of the process of my invention if the solvent is not only saturated with air, but excess air is introduced into the reaction zone and maintained in motion in order to maximize contact between oxygen and the kerogen exposed by the first pretreatment step of the process of my invention. This will require that several wells be completed in the zone where the extraction process is being applied, and ideally this involves injecting the solvent as needed to maintain the solvent level in the extraction zone of the oil shale formation near the top of the formation and introducing air into a separate well, ideally one which is located on the opposite side of the solvent injection well from the original well, which can be utilized for production of fluids to the surface of the earth, so air passage through the rubbilized oil shale material occurs. A mixture or solution of solvent and the hydrocarbon or organic fractions removed from the kerogen polymers by oxidative scission is produced to the surface of the earth through a well such as the well originally used for introducing tetralin into the formation. The fluid is then subjected to separation, and the preferred method involves separation by sublimation, which separates the solvent and hydrocarbon fractions by thermal means. The solvent, of course, can be reinjected into the formation in order to minimize the amount of solvent required for this process. The process can be continued so long as the amount of hydrocarbon being separated from the produced solvent is sufficient to justify continuation thereof.

After further operation of the second step of the process of my invention is terminated, additional kerogen can be recovered from the treated residual solids in the recovery zone of the formation by a variation of the high temperature bake-off procedure described in my U.S. Pat. No. 4,566,964 by injecting high temperature steam into the zone. This separates additional hydrocarbon materials from the residual kerogen which has not been affected by the oxidative treatment, producing a fluid which can be transported to the surface of the earth for separation there.

Reference is made to the experimental work reported in detail in U.S. Pat. No. 4,566,964 and such disclosure is incorporated herein by reference. Briefly, it was found that chemical separation of hydrocarbons from ground oil shale materials was achieved in a process in which ground oil shale materials were subjected to air and suitable solvents for the organic fractions extracted by oxidative scission from the kerogen polymer, specifically mixtures of air with naphthalene, tetralin and phenanthracene at temperatures of from 100° C. to 300° C. From 29.8 to 40.73% of the total organic carbon was recovered from the oil shale samples. It was also reported that the residual oil shale mineral which contain some unextracted kerogen could then be subjected to a bake-off stage at a temperature of 400 to 750° F. which increased the total recovery to a value in the range of 33 to 97%. Any of the variations in oxidative separation of organic fractions from the kerogen and the additional recovery by high temperature bake-off disclosed in U.S. Pat. No. 4,566,964 may be incorporated in the process of the present invention, utilizing oil shale materials, which were first chemically disintegrated by long term exposure to tetralin in situ in the formation followed by the oxidative step optionally followed by the bake-off step, all conducted in the subterranean formation.

The following summarizes the results of the various oxidation separation methods reported in U.S. Pat. No. 4,566,964.

TABLE 1

RESULTS OF VARIOUS OXIDATION METHODS

| EXAMPLE NO. | METHOD | TOC | % Removed |
|---|---|---|---|
| — | Untreated Tar Sand Material | 15.1 | — |
| 1 | Air/Naphthalene (100° C. pH 7) | 10.6 | 29.80 |
| 2 | Air/Naphthalene (100° C. pH 4) | 10.12 | 32.98 |
| 3 | Air/Naphthalene (100° C. pH 4) $KI/I_2$ | 9.16 | 39.34 |
| 4 | Air/Tetralin (100° C. pH 4) | 9.39 | 37.81 |
| 5 | Air/Naphthalene (100° C. pH 4) Phosphate | 9.23 | 38.87 |
| 6 | Air/Phenanthracene (100° C. pH 4 | 9.56 | 36.69 |
| 7 | Air/Phenanthracene (200° C.) | 9.10 | 39.74 |
| 8 | Air/Phenanthracene (300° C.) | 8.95 | 40.73 |
| 9 | Air/Phenanthracene (100° C.) 400° F. bake-off | 10.01 | 33.71 |
| 10 | Air/Phenanthracene (100° C.) 500° F. bake-off | 6.16 | 59.21 |
| 11 | Air/Phenanthracene (100° C.) 600° F. bake-off | 2.28 | 84.90 |
| 12 | Air/Phenanthracene (100° C.) 750° F. bake-off | .44 | 97.09 |
| 13 | No Oxidation/ 750° F. Bake-off | 3.75 | 75.17 |
| 14 | Air/Tetralin (100° C. pH 4) Phosphate | 9.27 | 38.61 |
| 15 | Air/Naphthalene (100° C. pH 4) Phosphate $KI/I_2$ | 9.17 | 39.27 |
| 16 | Air/Tetralin (100° C. pH 4) Phosphate $KI/I_2$ | 9.20 | 39.07 |

EXPERIMENTAL SECTION

The following experimental work is concerned only with the chemical pretreatment stage which is utilized to disintegrate fractured oil shale material in the subterranean deposit.

In the first experiment, a cube of oil shale of roughly one inch on a side, was placed in a laboratory pressure chamber, or bomb. The bomb was evacuated and gaseous hydrogen was introduced into the bomb to a pressure of 300 pounds per square inch, and allowed to remain in contact with the cube of oil shale for two days at ambient temperatures. Subsequently, the cube of oil shale material was subjected to oxidative scission with naphthalene and only an insignificant amount of hydrocarbon recovery was obtained. There was no visible change in the cube of oil shale material. This clearly indicated that hydrogen gas alone did not accomplish significant disintegration of the cube of oil shale material necessary to permit significant recovery of hydrocarbon fractions from the kerogen component of the oil shale by my oxidative scission process.

In the second experiment, a cube of oil shale rock from the same source was placed in a bomb and covered with tetralin. The cell was then pressurized with hydrogen to 300 pounds per square inch. The cube was allowed to remain in the tetralin environment pressurized with hydrogen for four days, after which it was removed and examined. Considerable shattering of the rock occurred, and the texture appeared as though it had been crushed. The chemically shattered oil shale material was then subjected to oxidative scission using naphthalene and air, and approximately 40% of the total organic carbon content of the oil shale cube was recovered.

DESCRIPTION OF A PREFERRED PROCESS

For purposes of additional disclosure including a disclosure of the best mode, the following is a description of a preferred embodiment of the process of my invention. The understanding of this embodiment will be aided by reference to the attached drawing, in which oil shale deposit 1 is located under an overburden formation 2 which is several times the thickness of the oil shale deposit 1, thereby rendering strip mining economically unfeasible. A well 3 is drilled into the oil shale deposit to a depth near the bottom of oil shale deposit 1. Conventional hydraulic fracturing is applied to the rock of oil shale deposit 1, causing the formation of fractures within the zone immediately adjacent to the well. Next, a suitable amount of dynamite is placed at several depths within the portion of the well penetrating the oil shale formation and detonated, which results in the formation of a zone of rubbilized rock 4 immediately adjacent to the wellbore. Fractures form a zone 5 extending out beyond the rubbilized area, which results in a substantial amount of access being achieved between fluid injected into well 3 and the oil shale material. Since oil shale mineral is very impermeable to liquid flow, it would be virtually impossible to contact a significant amount of the formation with the second stage treating process described below without the prior step of fracturing and/or explosive treatment to form the rubbilized and fractured zone in the formation.

After completion of this first step, well 3 is completed with a suitable injection casing including sealing means 6, such as a good cement job as used in ordinary well completion techniques, which ensures that pressure may be applied to the zones 4 and 5 formed within the oil shale deposit without excessive leakage of fluids along the outside of the casing of well 3. Tetralin is then introduced into the void spaces in the rubbilized zone 4 and fractured zone 5, and sufficient tetralin is injected to bring the solvent level within the well to a point very near the interface between the top of oil shale deposit 1 and the lower portion of overburden formation 2. Next, hydrogen gas is applied to the well to pressurize the tetralin within the formation. Since it is known from prior experience in this area that as much as 1,500 pounds of pressure may be applied to a formation over a long period of time without any danger of rupturing the overburden formation 2, the pressure is maintained at 1,500 pounds. An automatic pressure monitoring the device is attached to the wellhead of well 3 and utilized to measure the pressure within the well. Periodically, additional hydrogen is added to well 3 during the prolonged period of contact between the injected tetralin and the oil shale materials, in order to maintain the pressure in the range of from about 1,500 pounds to about 1,000 pounds per square inch. Tetralin is allowed to remain in the void spaces of the treated portion of the formation for a period of 300 days, which is sufficient to ensure that atomic hydrogen from the hydrogen doner solvent tetralin has penetrated a large portions of formation rock both in the rubbilized zone 4 and in the fractured zone 5. After 300 days, the hydrogen is removed from the well and wells 7 and 8 are completed in the outer part of the pretreated portion of the formation for injection of solvent and air. Since the formation is already saturated with tetralin, tetralin is used as the solvent for the organic fractions to be separated from the kerogen and molecules by the second stage oxidative scission step, although naphthalene or phenanthracene could also be used. Air is injected into well 8, tetralin is injected into well 7 and fluid recovery is taken from well 3. Oxidation of the outer portion of the exposed kerogen molecules within the pretreated formation removes organic fragments from the kerogen, which is dissolved in the tetralin and transported to the surface of the earth through well 3. Additional tetralin is added to the formation via well 7 in about the same rate as fluids are recovered from well 3, in order to ensure that the treated zone within the oil shale deposit is maintained essentially full of tetralin. During this period, air injection into the formation by well 7 is maintained at a value of about 4 standard cubic feet per hour per linear foot of hole, which ensures that tetralin within the formation is saturated with oxygen from the air, and also that gaseous phase excess air exists within the portion of the formation adjacent to the air and solvent injection well, which maximizes the oxidative effect in this stage.

Fluids recovered to the surface of the earth via well 3 are transported along line 9 to a separation means 10, which is preferably a vessel containing a heating device which separates the solvent and organic fractions by sublimation. The organic materials obtained from oxidative scission from the kerogen molecules is transported to a suitable container by line 11, while solvent leaves the separation apparatus via line 12, where it is reintroduced into the portion of the formation being exploited by this process. Additional solvent is supplied as needed from solvent make-up tank 13 via line 14, where it mixes with the recovered tetralin solvent from line 12.

This phase of recovery program continues until the percent of organic fractions derived from the kerogen decreases to a value in the range of from 15 to 20 percent by volume, which indicates that the second stage process has recovered about as much hydrocarbon fractions from the kerogen as is possible. The process may be terminated at this point, and recoveries in the range of from 35 to 45 percent of the kerogen present in the portion of the formation which has been contacted by the preceding process will have been achieved, which is excellent by normal standards of in situ recovery from oil shale deposit. Additional recovery is possible, however, by applying a type of bake-off similar to that described in my U.S. Pat. No. 4,566,964. Since the residual oil shale material with unoxidized kerogen remains in the formation, high temperature steam injection must be utilized from this portion of the process. The prior treatment with tetralin and oxygen will have greatly increased the susceptibility of the remaining kerogen to recovery by this method, since ordinarily steam injection is not affective for recovering kerogen from oil shale deposits. By injecting steam whose temperature is in the range of from 650 to 750° F. into the formation by a well such as well 8 in the attached drawing, while producing fluids from the formation via well 3, it is possible to increase the total recovery from the formation to a value in the range of from 95 to 99 percent of the total hydrocarbon present in the portion of the formation treated in the above process.

While my invention has been described in terms of a number of specific illustrative embodiments, it is not so limited as many variations thereof will be apparent to persons skilled in the related art without departing from the true spirit and scope of my invention. It is my intention that my invention be limited only by the limitations imposed in the claims appended hereinafter below.

What is claimed is:

1. An in situ method for recovering hydrocarbons from subterranean oil shale deposits, said deposits comprising mineral rock and kerogen, comprising (a) penetrating the oil shale deposit with at least one well;

(b) forming a zone of fractured and/or rubbilized oil shale material adjacent the well by hydraulic or explosive fracturing;

(c) introducing a hydrogen donor solvent including tetralin into the portion of the oil shale formation treated in step (b) in a volume sufficient to fill substantially all of the void space created by the fracturing and rubbilizing treatment;

(d) applying hydrogen to the tetralin and maintaining a predetermined pressure for a predetermined period of time sufficient to cause disintegration of the oil shale material;

(e) thereafter introducing an oxidative environment into said portion of the oil shale deposit comprising a free oxygen containing gas for sufficient time to cause oxidative scission of a portion of the kerogen which produces organic fragments removed from the kerogen, said oxidative environment also including a liquid solvent for the organic fragments;

(f) producing the solvent in organic fragments to the surface of the earth, and (g) separating the organic fragments from the solvent.

2. A method as recited in claim 1, wherein the hydrogen doner solvent utilized in step (c) is tetralin;

3. A method as recited in claim 1, wherein the hydrogen and hydrogen donor solvent is maintained in the oil shale formation for a period of time in the range of from 50 to 500 days.

4. A method as recited in claim 1, wherein the hydrogen and hydrogen doner solvent is maintained in the oil shale formation for a period of time in the range of from 250 to 350 days.

5. A method as recited in claim 1, wherein the hydrogen pressure is maintained in the range of from 50 to 500 pounds per square inch.

6. A method as recited in claim 1, wherein the hydrogen pressure is maintained in the range of from 250 to 350 pounds per square inch.

7. A method as recited in claim 1, wherein the solvent used the oxidative environment of step (e) is selected from the group consisting of naphthalene, tetralin, phenanthracene and mixtures thereof.

8. A method as recited in claim 7 wherein the solvent is naphthalene.

9. A method as recited in claim 7 wherein the solvent is tetralin.

10. A method as recited in claim 7 wherein the solvent is phenanthracene.

11. A method as recited in claim 1, wherein at least two additional wells are drilled into the portion of the formation prior to step (d), and solvent of step (d) is introduced into the formation via one well and the free oxygen containing gas is introduced into the formation via a separate well.

12. A method as recited in claim 1, wherein the free oxygen containing gas used in step (e) is air.

13. A method as recited in claim 1 wherein sufficient weak acid is added to reduce the pH of the oxidative environment to a value in the range of from 4 to 7.

14. A method as recited in claim 13 wherein the acid is selected from the group consisting of acetic acid, phosphoric acid, sulfurous acid, sulfamic acid and mixtures thereof.

15. A method as recited in claim 1 wherein the oxidative environment also contains a mixture of potassium iodide and iodine.

16. A method as recited in claim 15 wherein the amount of the mixture of potassium iodide and iodine is from 0.25 to 1.0% by weight.

17. A method as recited in claim 16 wherein the molar ratio of the mixture of potassium iodide and iodine added to the oxidative environment is from 1/400 to 1/100.

18. A method as recited in claim 1 wherein an effective amount of an inorganic phosphate is added to the oxidative environment.

19. A method as recited in claim 18 wherein the inorganic phosphate is sodium phosphate.

20. A method as recited in claim 18 wherein the concentration of phosphate added to the oxidative environment is from 1 to 7% by weight.

21. A method as recited in claim 1 comprising the additional step, after completion of step (e), of introducing a hot gaseous material into the oil shale formation to recover additional hydrocarbon materials from the unoxidized kerogen present in the formation by an in situ high temperature bake-off.

22. A method as recited in claim 21, wherein the temperature of a fluid is from 650 to 750° F.

23. A method as recited in claim 21 wherein the fluid introduced into the formation is steam.

* * * * *